US006694534B2

(12) United States Patent
Stone

(10) Patent No.: US 6,694,534 B2
(45) Date of Patent: Feb. 24, 2004

(54) TOILET VENTILATION SYSTEM

(76) Inventor: Earlyn W. Stone, 390 W. Seventh St., No. 8, San Jacinto, CA (US) 92583

( * ) Notice: Subject to any disclaimer, the term of this patent is extended or adjusted under 35 U.S.C. 154(b) by 4 days.

(21) Appl. No.: 10/228,424

(22) Filed: Aug. 26, 2002

(65) Prior Publication Data

US 2003/0163863 A1 Sep. 4, 2003

Related U.S. Application Data

(60) Provisional application No. 60/360,895, filed on Mar. 4, 2002.

(51) Int. Cl.[7] ..... E02D 9/04

(52) U.S. Cl. ..... 4/213; 4/216; 4/228.1; 4/347

(58) Field of Search ..... 4/213, 216, 217, 4/228.1, 347–350

(56) References Cited

U.S. PATENT DOCUMENTS

| | | | | | |
|---|---|---|---|---|---|
| 2,297,935 | A | * | 10/1942 | Baither | 4/213 |
| 2,985,890 | A | * | 5/1961 | Baither | 4/213 |
| 3,763,505 | A | * | 10/1973 | Zimmerman | 4/213 |
| 4,031,574 | A | * | 6/1977 | Werner | 4/213 |
| 4,059,857 | A | | 11/1977 | Poister | 4/213 |
| 4,103,370 | A | * | 8/1978 | Arnold | 4/213 |
| 4,117,559 | A | | 10/1978 | Boyle | 4/209 |
| 4,168,553 | A | | 9/1979 | Studer | 4/348 |
| 4,175,293 | A | | 11/1979 | Stephens et al. | 4/209 |
| 4,200,940 | A | | 5/1980 | Buchanan | 4/348 |
| 4,318,192 | A | * | 3/1982 | Williams et al. | 4/213 |
| 4,583,250 | A | * | 4/1986 | Valarao | 4/213 |
| 4,800,596 | A | * | 1/1989 | Menge | 4/348 |
| 4,864,664 | A | * | 9/1989 | Higgins | 4/213 |
| 4,933,995 | A | * | 6/1990 | Canon | 4/209 R |
| 5,029,346 | A | * | 7/1991 | Fernald, Sr. | 4/213 |
| 5,136,729 | A | | 8/1992 | Ricard | 4/213 |
| 5,161,262 | A | | 11/1992 | Quaintance, Sr. | 4/213 |
| 5,210,884 | A | | 5/1993 | Redford | 4/348 |
| 5,231,705 | A | * | 8/1993 | Ragusa | 4/213 |
| 5,255,395 | A | | 10/1993 | Millette | 4/216 |
| 5,321,856 | A | | 6/1994 | Gastesi | 4/213 |
| 5,325,544 | A | * | 7/1994 | Busch | 4/213 |
| 5,369,810 | A | * | 12/1994 | Warren | 4/213 |
| 5,606,747 | A | * | 3/1997 | Dupont | 4/213 |
| 6,158,058 | A | | 12/2000 | Martens | 4/216 |
| 6,279,173 | B1 | * | 8/2001 | Denzin et al. | 4/213 |
| 6,370,703 | B1 | * | 4/2002 | Kim et al. | 4/216 |

* cited by examiner

*Primary Examiner*—Gregory Huson
*Assistant Examiner*—Amanda Flynn
(74) *Attorney, Agent, or Firm*—Calif Tervo

(57) ABSTRACT

A ventilation system (10) for a conventional flush toilet (100) generally comprises a battery (20); an air sweetener (30) in a water tank (140) for deodorizing or scenting air (90D); an air flow device (40) positioned within a tank (140) including a duct (50) with a fan (60) therein, and an electrical circuit (70) powering a fan (60) when a circuit (70) is activated. The duct (50) receives a bowl filling hose (166) and attaches to a top end (172) of a bowl fill pipe (170) so as to receive air from a bowl (120). A float switch (80) may deactivate a fan circuit (70) after flushing.

5 Claims, 2 Drawing Sheets

TOILET VENTILATION SYSTEM

CROSS-REFERENCE TO RELATED APPLICATIONS

This application claims the benefit of U.S. Provisional Application No. 60/360,895 filed Mar. 4, 2002.

FIELD OF THE INVENTION

This invention relates in general to toilet ventilation systems and more particularly to a system for deodorizing or perfuming air extracted from the toilet bowl through the flush tank.

BACKGROUND OF THE INVENTION

Various systems have been proposed for eliminating odoriferous gases associated with flush toilets However, although the need has been articulated for decades, no odor removing system has gained widespread acceptance Thus, there remains a need for a toilet ventilation system that is easily added to a conventional toilet by the user, that requires no modification to the room, that deodorizes and/or perfumes air from the bowl, that does not present any electrical hazard, that is entirely or substantially concealed, that does not require cleaning arising from use of the toilet, and that requires extremely little maintenance.

SUMMARY OF THE INVENTION

This invention is a ventilation system for the bowl of conventional flush toilet of the type having a bowl with an opening disposed about its rim, a tank connected to the bowl for storing water at a storage water level, a bowl filling hose in the tank, and a bowl fill pipe interconnecting the tank with the rim opening The bowl fill pipe includes a top end for receiving water from the bowl filling hose and an opening in fluid communication with the bowl rim opening.

The ventilation system generally comprises a battery for supplying electrical power, air sweetening means in the tank for deodorizing or scenting air; air flow means positioned within the tank including a duct and a fan, and an electrical circuit connecting the battery to the fan for powering the fan when the circuit is activated.

The duct is adapted for receiving the bowl filling hose and for attachment to the top end of the bowl fill pipe so as to receive air from the top end opening of the bowl fill pipe and not from the tank when water is at least at stored water level The fan in the duct moves air from the bowl through the rim openings, out the fill pipe opening, and over the air sweetening means such that sweetened air is expelled from the tank The air sweetener may be a deodorizer, such as a charcoal filter, or a perfumer, such as a perfume dispenser Alternative embodiments of the ventilation system are described The system may be disposed entirely within the tank Alternatively, a fan switch external the tank may activate the fan circuit. A push button switch under the seat may activate the fan circuit by the act of a user sitting on the toilet. Alternatively, a fan switch external the tank may activate the fan circuit and a timer circuit may deactivate the fan circuit a predetermined time period after activation or a float switch in the tank may deactivate the fan circuit after flushing.

Other features and many attendant advantages of the invention will become more apparent upon a reading of the following detailed description together with the drawings wherein like reference numerals refer to like parts throughout.

DETAILED DESCRIPTION OF THE INVENTION

Figure 1:
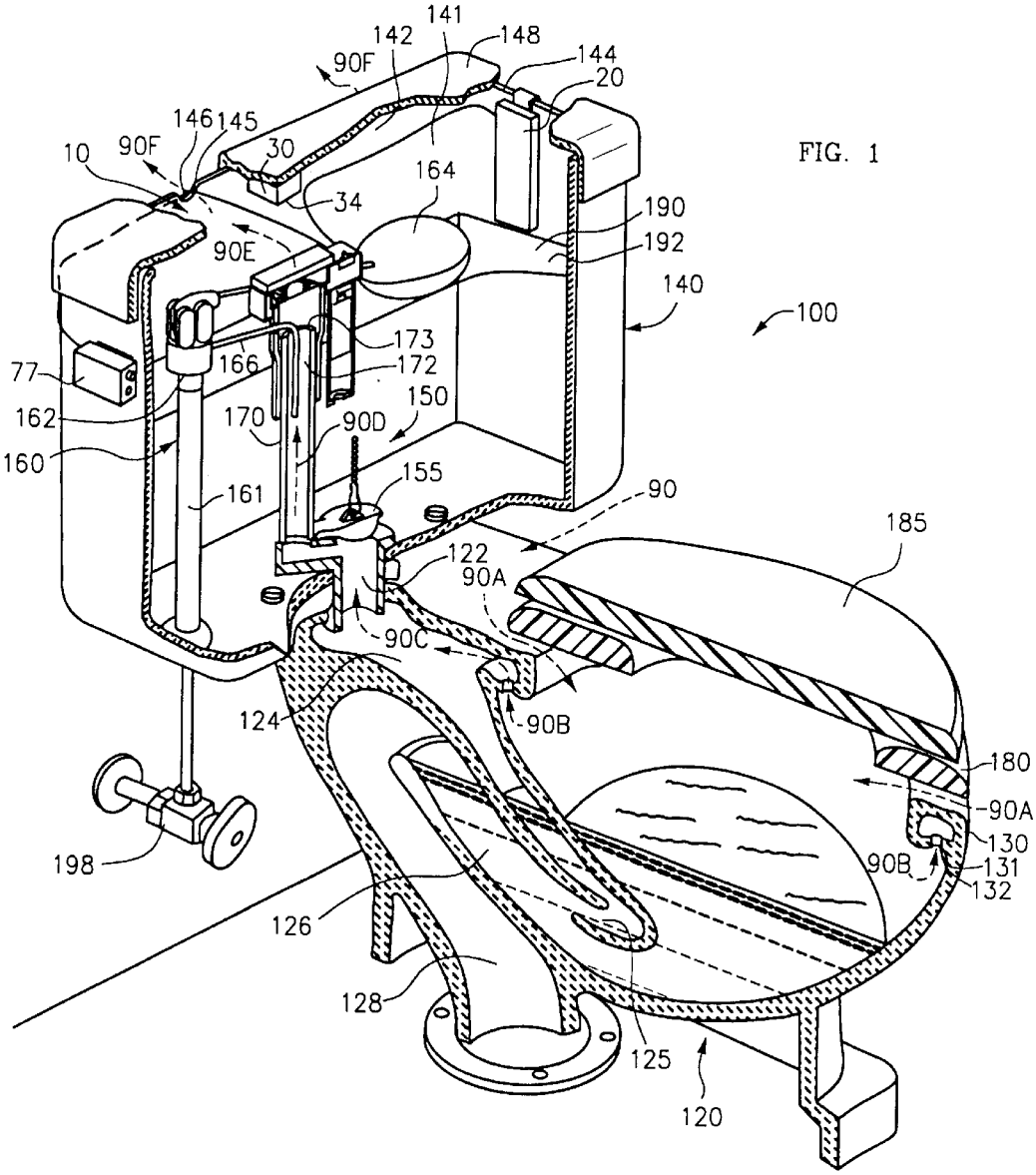
FIG. 1 is a perspective view, partially cut away, of a toilet and ventilation system of the invention.

FIG. 1 is a perspective view, partially cut away, of a conventional toilet 100 with one embodiment of the ventilation system 10 of the invention attached thereto. Toilet 100 includes, in general, a tank 140 including an enclosed space 141 for storing water 190, a bowl 120, a seat 180 for sitting on by a user, and a lid 185 for covering bowl 120.

Bowl 120 includes a hollow rim 130 having an opening 131, such as a plurality of openings 132 disposed about rim 130. Bowl 120 includes a flush conduit 122 for receiving flush water from tank 140, a main water passage 124 for dispersing received water out rim openings 132 and flush jet 125, a trap 126 and drain 128.

Tank 140 includes, in general, a lid 148, flush apparatus 150 including a flapper valve 155; water replenishing apparatus 160, and a tank overflow and bowl fill pipe 170. Lid 148 covers tank 140 such that air may flow between enclosed space 141 and the atmosphere. Air flows under lid 148 into tank 140 upon flushing to replace the flush water Typically, tank 140 includes an upright wall 142 having an upper edge 144 including orifices 145, such as scallops 146 allowing for passage of air between wall 142 and lid 148. Alternately, lid 148 may have small nubs, not shown, on the underside supporting it on wall 142 and providing openings.

Figure 2:
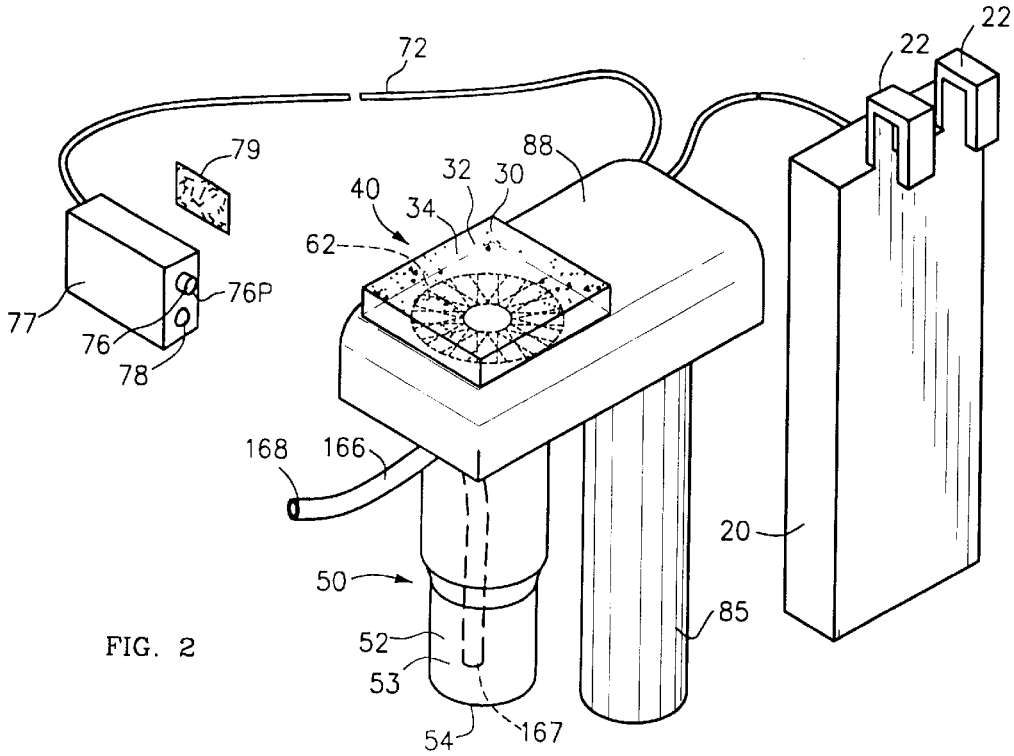
FIG. 2 is a perspective view of an exemplary embodiment of the ventilation system
Figure 3:
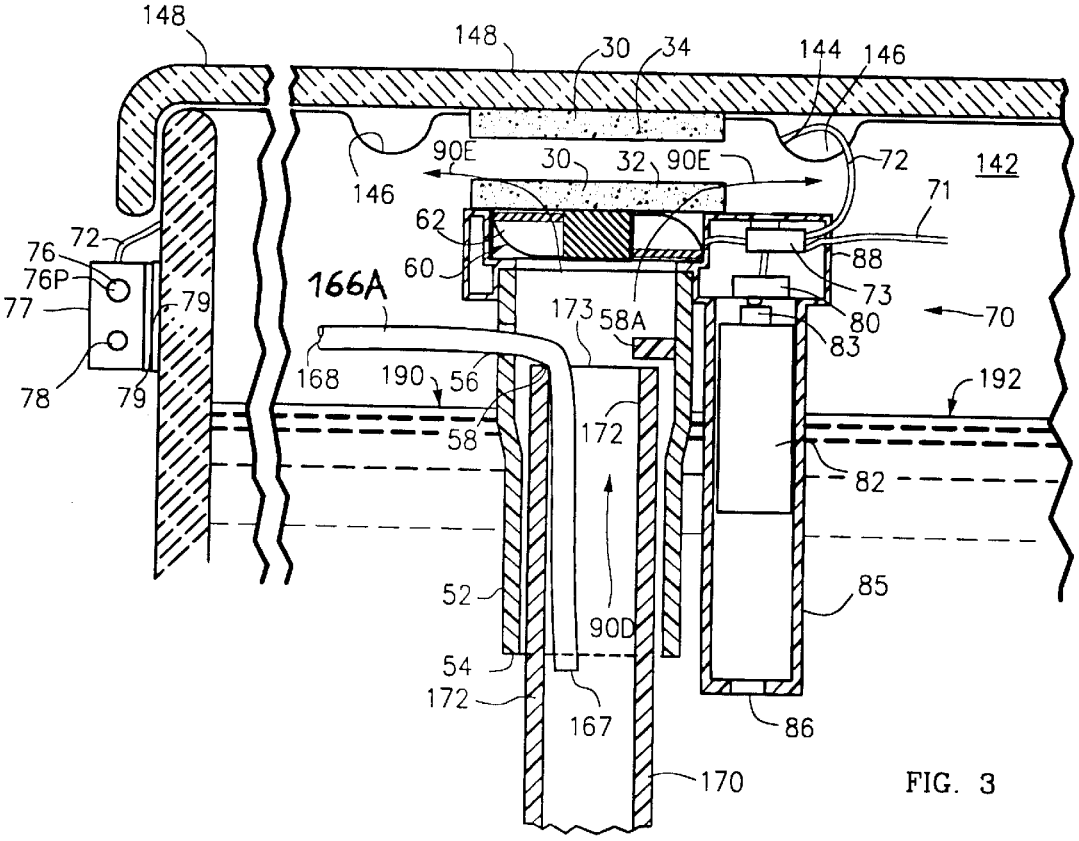
FIG. 3 is a front cross sectional view of the toilet tank and ventilation apparatus

Water replenishing apparatus 160 includes a water intake tube 161, a water valve 162 receiving water from building water supply 198, a float 164 controlling water valve 162, and a bowl refill hose 166. Bowl fill pipe 170 interconnects tank 140 with rim openings 132. Bowl fill pipe 170 has a top end 172 including an opening 173 in fluid communication with rim openings 132. Pipe opening 173 provides overflow of water 190 from tank 140 should water replenish apparatus 160 malfunction. Bowl refilling hose 166 provides water after flushing from water replenishing apparatus 160 to bowl fill pipe 170 to refill bowl 120 Water 190 is stored in space 141 at a storage level 192 suitable for flushing bowl 120. Although one type of conventional toilet has been shown, it will be seen that the ventilation system 10 of the invention is applicable to other types of toilets For example, a float on a lever arm is shown, however, the float could be on water intake tube 161 or elsewhere Looking now also at FIGS. 2 and 3, FIG. 2 is a perspective view of an exemplary embodiment of ventilation system 10, and FIG. 3 is a front cross sectional view of toilet tank 140 and ventilation apparatus 10

Ventilation system 10 generally comprises a battery 20 for supplying electrical power; air sweetener 30 in tank 140 for deodorizing or for scenting air 90D, air flow means 40 positioned within tank 140, and an electrical circuit 70 connecting battery 20 to air flow means 40 for powering air flow means 40.

Air flow means 40 generally includes duct means 50 and fan means 60. Duct means 50 is adapted for receiving bowl filling hose 166 and adapted for attachment to top end 172 of bowl fill pipe 170 in a sealed relationship so as to receive air 90D from top end opening 173 and not from tank 140 when water 190 is at least at storage water level 192 In the exemplary embodiments, duct means 50 generally includes a cylindrical duct 52 and fan means 60, such as fan 62 in the duct. Duct 52 includes a cylindrical lower end 53 that mounts on bowl fill pipe 170. Preferably, duct mounting end 53 is of sufficient inside diameter so as to mount over bowl fill pipes 170 of different sizes with sufficient remaining space around the different sized fill pipes to allow water to flow up the space between duct 52 and fill pipe 170 in case of a malfunction causing an overflow condition in the tank. The length of duct 52 is such that bottom end 54 of duct 52 resides below storage level 192 of stored water 190 such that, during normal operation, duct 52 is sealed from any air flow from a source other than fill pipe 170

Duct 52 includes a through bore 56 for receiving bowl filling hose 166 such that exit end 167 expels water into fill pipe 170. Alternatively, if duct 52 has its own bowl filling hose 166A having an entry end 168, original bowl filling hose 166 can be removed and entry end 168 of new hose 166A can be attached to water replenishing apparatus 160 instead.

Duct 52 includes stop means 58 for preventing downward movement of duct 52 on bowl fill pipe 170. In the preferred embodiment, bowl filling hose 166 or 166A acts as a stop against open end 173 of pipe 170. Alternatively, means such as stop 58A, shown in phantom, from duct 52 and resting on opening 173 could be used The path for flow of air 90 thus established is as follows. Air 90A passes around seat 180 and enters bowl 120 Air 90B in bowl 120 enters rim 130 through rim openings 132 Air 90C leaves rim 130 and passes through main passage 124 and flush conduit 122 and into fill pipe 170. Air 90*d* in fill pipe 170 passes out opening 173 into duct 52, through fan 62, and over air sweetener 30 and enters tank 140. Air 90E from tank 140 passes under lid 148 to enter the room as sweetened air 90F.

Air sweetener 30 may be a true deodorizer, such as a charcoal filter 32, or may be a fragrance dispenser 34 for adding pleasant odors, or a combination of both Air sweetener 30 may be inserted directly into duct 52 or at exit of duct 52 so that expelled air must pass through, or may be otherwise placed in tank 140, such as attached to bottom of lid 148 above fan 62 such that air passes over it. In FIG. 3, a fragrance dispenser 34 is shown attached to bottom of lid 148. Preferably, air sweetener 30 is easily replaceable, such as being mounted in a housing or with hook/loop fastener or the like.

Electrical circuit 70 connects battery 20 to fan 62 for powering fan 62 when circuit 70 is activated. Preferably, battery 20 includes a mounting means, such as bracket 22 adapted for attachment to part of the conventional toilet 100, such as over upper edge 144 of upright wall 142. Several alternative electrical circuits 70 are described. In the simplest method, battery 20 may be connected, such as by wire 71, directly to fan 62.

An alternate power source, not internal, could be used, such as an AC to DC converter converting house line voltage 110AC to 12DC. Such converters are readily available. This does not present any hazard and eliminates replacement of batteries. However, the visible converter and power cord are undesirable, and, typically, no 110AC outlet is conveniently located To reduce battery, fan, and fragrance use, it is desirable to have means for activating and de-activating fan 62. The embodiment of ventilation system 10 shown in the drawings includes means, such as external switch 76, outside of tank 140 for activating or de-activating fan 62. Housing 88 is attached to airflow means 40 and contains electrical circuitry 70, such as printed circuit board 73, for executing the functions described herein as could readily be configured by one reasonably skilled in the art External switch 76 may be an on/off switch, such as a manual toggle switch, for powering fan. An indicator, such as a light, such as LED 78 is lit to indicate fan 62 is activated. Wires 72 to external switch 76 and indicator LED 78 in enclosure 77 may be run through a scallop 146 in tank 140. Enclosure 77 containing external switch 76 and LED indicator 78 may be attached to toilet 100, such as to tank 140, by any suitable means, such as by adhesive or mating hook/loop fastener strips 79

Alternatively, external switch 76 may be a push button switch 76P switchable between an off position and an on position activating circuit 70 and biased to the off position such that it must be engaged for activation. Push button switch 76P may be mounted other locations, such as between seat 180 and bowl 120, not shown, such that it is switched to and maintained in the on position by the act of a user sitting on the toilet Alternatively, external push button switch 76P may activate circuit 70 and a circuit board 73 may include a timing circuit that de-activates circuit 70 after a predetermined time after activation, such as 5 minutes Alternatively, another switch, such as float switch 80 in housing 88 may be required to be active for circuit 70 to be activated or for circuit 70 to remain active. Float switch 80 is active when a float 82 is an upper position buoyed by normal storage tank water 190, such as in cylinder 85, and is inactive when float 82 moves to a lower position during flushing as the water level drops as the water exits cylinder 85 out drain hole 86. Float switch 80 may be switched in several manners. For example, it may be a pressure switch such that float 82 acts on it with physical pressure or it may be a magnetic switch, such that float 82 includes a magnet 83 Thus, if external push button switch 76P is temporarily pushed on while float switch is active, circuit 70 will be activated until float switch 80 is inactive after flushing. Circuit 70 then stays inactive until external push button switch 76P is again activated.

Alternatively, an external light-recognition switch could be used A preferred light-recognition switch uses two photoresistance cells that establish a balanced, nonconductive condition when both cells are exposed to the same intensity of light. Both cells are positioned, such as externally above lid 148, to receive light from the room, but one cell is more blocked by person sitting on the seat thereby creating an imbalance that activates the switch. The switch deactivates when the person moves from the seat This system does not require a manual switch or float to activate or deactivate the system It can be seen that the present invention provides a very convenient device for eliminating toilet odors.

Although a particular embodiment of the invention has been illustrated and described, various changes may be made in the form, composition, construction, and arrangement of the parts herein without sacrificing any of its advantages. Therefore, it is to be understood that all matter herein is to be interpreted as illustrative and not in any limiting sense, and it is intended to cover in the appended claims such modifications as come within the true spirit and scope of the invention.

I claim:

1. A ventilation system for use with a toilet including a bowl with an opening disposed about its rim, a tank for storing water at a storage water level, a bowl filling hose, and a bowl fill pipe interconnecting the tank with the rim opening, the bowl fill pipe having a top end including an opening in fluid communication with the rim opening, said ventilation system comprising:

a battery mounted to the toilet for supplying electrical power;

air sweetening means in the tank for deodorizing or scenting air;

air flow means positioned within the tank including:

duct means adapted for receiving the bowl filling hose and adapted for attachment to the top end of the bowl fill pipe so as to receive air from the top end opening of the bowl fill pipe and not from the tank when water is at least at the storage water level; and fan means in said duct for moving air from the bowl through the rim openings, out the fill pipe opening, and over said air sweetening means such that sweetened air is expelled from the tank; and an electrical circuit connecting said battery to said fan for powering said fan when said circuit is activated; said electrical circuit including:

a float switch including a float buoyed by tank water; said float switch having an active position when tank water level is above a predetermined level and having an inactive position when tank water level drops below a predetermined level; and an external fan switch external the tank switchable between an inactive position and an active position, whereby, if said float switch is active, said circuit will be activated until said float switch is inactive.

2. The ventilation system of claim 1 wherein:

said external fan switch is biased to the inactive position.

3. The ventilation system of claim 1 wherein:

said external fan switch is biased to the inactive position and is switched to and maintained in the active position by the act of a user sitting on the toilet.

4. In combination:

a toilet including:

a bowl with an opening disposed about its rim;

a tank connected to said bowl for storing water at a storage water level;

a bowl filling hose in said tank; and a bowl fill pipe interconnecting said tank with said rim opening including:

a top end for receiving water from said bowl filling hose including:

an opening in fluid communication with said rim opening; and a ventilation system comprising:

a battery for supplying electrical power;

air sweetening means in said tank for deodorizing or scenting air;

air flow means positioned within said tank including:

duct means adapted for receiving said bowl filling hose and adapted for attachment to said top end of said bowl fill pipe so as to receive air from said top end opening of said bowl fill pipe and not from said tank when water is at least at stored water level; and fan means in said duct for moving air from said bowl through said rim openings, out said fill pipe opening, and over said air sweetening means such that sweetened air is expelled from said tank; and an electrical circuit connecting said battery to said fan for powering said fan when said circuit is activated; said electrical circuit comprising:

a float switch including a float buoyed by tank water; said float switch having an active position when tank water level is above a predetermined level and having an inactive position when tank water drops below a predetermined level; and an external fan switch external the tank switchable between an inactive position and an active position, whereby, if said float switch is active, said circuit will be activated until said float switch is inactive.

5. The combination of claim 4 wherein:

said external fan switch is biased to the inactive position.

* * * * *